US008940984B2

(12) United States Patent
Davies

(10) Patent No.: US 8,940,984 B2
(45) Date of Patent: Jan. 27, 2015

(54) ELECTRO-MECHANICAL MUSICAL INSTRUMENT

(71) Applicant: Hotspur Management Pty Ltd, Clifton Hill, Victoria (AU)

(72) Inventor: Paul Llewellyn Davies, Rye (AU)

(73) Assignee: Hotspur Management Pty Ltd, West Melbourne, Victoria (AU)

( * ) Notice: Subject to any disclaimer, the term of this patent is extended or adjusted under 35 U.S.C. 154(b) by 0 days.

(21) Appl. No.: 14/075,096

(22) Filed: Nov. 8, 2013

(65) Prior Publication Data

US 2014/0060291 A1 Mar. 6, 2014

Related U.S. Application Data

(63) Continuation of application No. PCT/AU2012/000477, filed on May 4, 2012.

(30) Foreign Application Priority Data

May 10, 2011 (AU) ..... 2011901762

(51) Int. Cl.
*G10D 1/02* (2006.01)
*G10H 3/18* (2006.01)
*G10D 3/02* (2006.01)

(52) U.S. Cl.
CPC ..... *G10H 3/181* (2013.01); *G10D 1/02* (2013.01); *G10D 3/02* (2013.01)
USPC ..... 84/280

(58) Field of Classification Search
CPC ..... G10H 3/181; G10D 1/02; G10D 3/02
See application file for complete search history.

(56) References Cited

U.S. PATENT DOCUMENTS

| | | | | | |
|---|---|---|---|---|---|
| 519,416 | A | * | 5/1894 | Turner | 84/299 |
| 703,572 | A | * | 7/1902 | Grienauer | 84/275 |
| 878,124 | A | * | 2/1908 | D'Armon | 84/277 |
| 895,189 | A | * | 8/1908 | Nusekabel | 84/274 |
| 1,214,075 | A | * | 1/1917 | Rice | 84/295 |
| 1,317,089 | A | * | 9/1919 | Maine | 84/275 |
| 1,671,532 | A | * | 5/1928 | Lemansky et al. | 84/275 |
| 1,767,678 | A | * | 6/1930 | Hutchison | 84/192 |

(Continued)

FOREIGN PATENT DOCUMENTS

EP 0911800 4/1999

OTHER PUBLICATIONS

International Search Report; PCT/AU2012/000477; Jun. 5, 2012; C. Rees; 2 pp.

*Primary Examiner* — Robert W Horn
(74) *Attorney, Agent, or Firm* — Fish & Richardson P.C.

(57) ABSTRACT

An electro-mechanical musical instrument capable of generating a whole or partial instrument resonant frequency, said instrument comprising a body (1) having a first end (2) and a second end (3), a soundboard (4) positioned between said first and second ends adapted to generate a live frequency response and a contact microphone or sensor (5) adapted to receive said resonant frequency wherein said body includes a rigid member (6) positioned between said first and second ends of said body, said rigid member being adapted to apply tension or compression between said first and second ends of said body and simultaneously contact said soundboard between said first and second body ends such that said application of tension or compression adjusts or modifies said resonant frequency of said instrument.

9 Claims, 3 Drawing Sheets

(56) References Cited

U.S. PATENT DOCUMENTS

| | | | | | |
|---|---|---|---|---|---|
| 1,788,745 | A | * | 1/1931 | Rowland | 84/276 |
| 1,897,531 | A | * | 2/1933 | Pasko | 84/277 |
| 2,145,978 | A | * | 2/1939 | Frazier | 84/276 |
| 2,162,595 | A | * | 6/1939 | Virzi | 84/277 |
| 3,302,507 | A | * | 2/1967 | Fender | 84/267 |
| 3,383,970 | A | * | 5/1968 | Di Sibio | 84/276 |
| 3,443,018 | A | * | 5/1969 | Krebs | 84/741 |
| 4,026,181 | A | * | 5/1977 | Barcus et al. | 84/291 |
| 4,206,678 | A | * | 6/1980 | Espinos Guerrero | 84/267 |
| 4,411,186 | A | * | 10/1983 | Faivre | 84/291 |
| 4,508,003 | A | * | 4/1985 | Smakula | 84/293 |
| 5,260,505 | A | * | 11/1993 | Kendall | 84/298 |
| 5,679,910 | A | * | 10/1997 | Steinberger et al. | 84/291 |
| 5,739,444 | A | * | 4/1998 | Borisoff | 84/291 |
| 6,459,024 | B1 | * | 10/2002 | Baker | 84/291 |
| 6,646,191 | B1 | * | 11/2003 | Martin | 84/291 |
| 6,884,932 | B2 | * | 4/2005 | Wrona et al. | 84/291 |
| 7,183,474 | B2 | * | 2/2007 | Barger | 84/290 |
| 7,446,247 | B2 | * | 11/2008 | Shellhammer | 84/291 |
| 7,462,767 | B1 | * | 12/2008 | Swift | 84/291 |
| 7,842,868 | B2 | * | 11/2010 | Else | 84/293 |
| 8,138,403 | B1 | * | 3/2012 | Kemp | 84/291 |
| 8,203,059 | B2 | * | 6/2012 | Miloslavsky | 84/291 |
| 8,404,956 | B2 | * | 3/2013 | Ragas et al. | 84/293 |
| 8,648,238 | B1 | * | 2/2014 | Trabits | 84/298 |
| 2007/0240555 | A1 | * | 10/2007 | Jakonczuk | 84/413 |
| 2008/0190263 | A1 | * | 8/2008 | Drew | 84/291 |
| 2014/0060291 | A1 | * | 3/2014 | Davies | 84/734 |

* cited by examiner

ELECTRO-MECHANICAL MUSICAL INSTRUMENT

CROSS-REFERENCE TO RELATED APPLICATIONS

The present application claims priority from Australian Provisional Patent Application No 2011901762, the entire content of which is incorporated herein by reference.

INTRODUCTION TO THE INVENTION

This invention relates to electric versions of traditional musical instruments, and in particular to an electro-mechanical musical instrument adapted to amplify a tonal response of the instrument by electrical or electronic sensing and includes a range of stringed instruments and other instruments capable of generating a resonant frequency from the whole or part of the whole instrument.

BACKGROUND TO THE INVENTION

The generation of sound using electric or electronic amplification of musical instruments ranges from entirely electronic instruments like the electric guitar operating off purely electrically generated signals to a range of essentially traditional acoustic instruments, incorporating microphone pickups or the like using traditional electronic amplification of the acoustic sound generated by an essentially traditional instrument. In between these two extremes, a range of semi-traditional electrically amplified instruments have been developed. However, attempts to develop a completely satisfactory electronic version of a stringed instrument of the type including violins, cellos and the like, has yet to achieve an entirely satisfactory result due to the artificial and/or unnatural rendition of the resonant frequencies of such instruments imparted by the electronic amplification. In particular, electronic versions of traditional stringed instruments have to date failed to capture or reproduce the whole instrument resonant frequency which characterises such instruments. One object of the current invention is to provide an improved musical instrument.

STATEMENTS OF THE INVENTION

In a first aspect the invention provides an electro-mechanical musical instrument capable of generating a whole or partial instrument resonant frequency said instrument comprising a body having a first end and a second end, a sound board positioned between said first and second ends adapted to generate a live frequency response and a contact microphone or sensor adapted to receive said resonant frequency wherein said body includes a rigid member positioned between said first and second ends of said body, said rigid member being adapted to apply tension or compression between said first and second ends of said body and simultaneously contact said soundboard between said first and second body ends such that said application of tension or compression adjusts or modifies said resonant frequency of said instrument.

The rigid member is preferably permanently fixed to said first end and adjustably fitted to said second end to allow ready adjustment to said tension or compression and resultant modification to said resonant frequency.

The adjustment can be either by compression or tension applied to the rigid member and is most preferably applied by compression.

The rigid member is preferably an elongate rod and may distort along its length during compression to bear upon said soundboard. The elongate rod is preferably substantially straight; but, may include a minor deviation along the longitudinal axis to bias the direction of said distortion so as to effect said contact between said rigid member and said soundboard.

The rigid member is most preferably selected from metals including mild steel, wood laminates or synthetic materials including polycarbonate/carbon fibre or combinations thereof.

The rigid member preferably includes a threaded portion at the second end fitted to the second end of said body and may be adjusted by rotation of a captive nut in said second end.

The contact microphone or sensor is preferably positioned for pickup under said soundboard adjacent said rigid member and most preferably adjacent said point of contact between said rigid member and said soundboard.

DETAILED DESCRIPTION OF THE INVENTION

The invention will now be described with reference to one particularly preferred embodiment of an electronic violin as shown in FIGS. 1 to 3 and the accompanying Legend.

LEGEND

Figure 1:
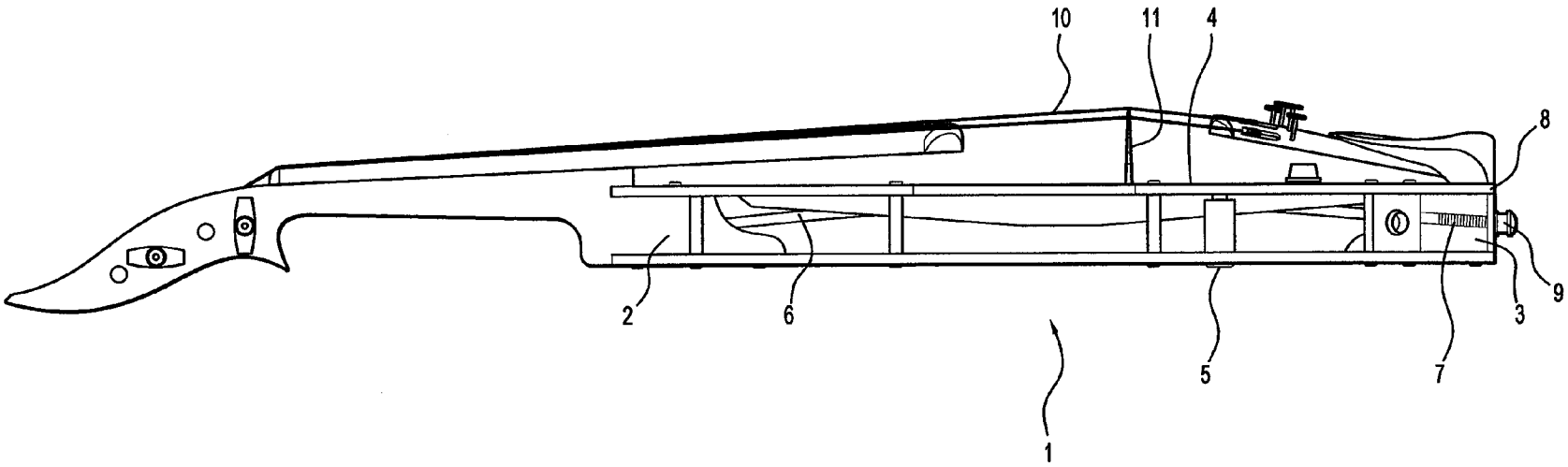
FIG. 1 shows a side view.

1. Body
2. Body first end
3. Body second end
4. Soundboard
5. Contact microphone/sensor
6. Rigid member
7. Threaded portion
8. Rigid member second end
9. Captive nut
10. Strings
11. Bridge Referring firstly to FIG. 1, a side view of the electro-mechanical musical instrument in the form of a violin is given. The particular embodiment of a violin is exemplary only as the musical instrument of the invention can be any musical instrument capable of generating a whole instrument resonant frequency or partial instrument resonant frequency by virtue of the acoustic behaviour of the body 1. The whole or partial instrument resonant frequency refers to the behaviour and acoustic performance of the body of the instrument, acting as a resonating unit thereby generating the principal sound of the instrument. Alternative instruments could include a range of stringed instruments or even an instrument like a drum, incorporating a body with a stretched skin as an alternative to tensioned strings.

The musical instrument comprises the body 1, having a first end 2 and a second end 3, which in the case of the violin as detailed in the example in the figures, has the first end 2 forming the top block and the second end 3 forming the end block of the body 1 of the violin. The instrument further includes a soundboard 4, which in the case of the violin is the soundboard adopting the top portion of the body between the first end 2 and the second end 3. Alternatively, in the case of a drum, the soundboard could be the stretched skin formed over the body of the drum.

The soundboard 4 is adapted to generate the live frequency response of the instrument. In the case of the violin this is generated by transfer of the vibrating strings 10 via the bridge 11 to the soundboard 4.

The instrument further includes a contact microphone or sensor 5 positioned in the case of the violin, in the region under the foot of the bridge and in the general position of the sound post as found in the analogous traditional instrument.

The contact microphone or sensor is adapted to receive and pick up the resonant frequency generated by the whole instrument body with the microphone having an appropriate sensor and adapted for amplification in the traditional way.

In a particularly preferred embodiment the microphone or sensor includes a piezo-crystal activated by the compression of the bridge/soundboard on the top surface of the sensor. The sensors acoustic resonant performance may be modified by adjusting the position of the sensor in relation to the bridge, therefore changing the pressure on said piezo-crystal.

The musical instrument of the invention is characterised by the provision of an elongate rigid member 6, positioned between the first end 2 or top block, and the second end 3 or end block, of the violin body. The rigid member preferably takes the form of a metallic rod and being fixed at the first end 2 and adjustable relative to the second end 3. The adjustment of the rigid member or metal rod 6 provides for reinforcement of the body of the violin; but, importantly and unexpectedly, adds a fine level of adjustment and modification of the inherent resonant frequency of the instrument whereby adjustment of the rigid member by either placing the rigid member in compression, relative to the first and second ends of the body or alternatively in tension, allows the resonant frequency of the whole instrument to be fine tuned and adjusted in accordance with requirements, atmospheric conditions or in the manner of adjusting the sound of the instrument in accordance with the taste or interest of the end user.

The rigid member is preferably placed into compression and is provided at a second end 8 with threading and is held in position at the second end 3 of the body 1 by way of a captive nut whereby rotation of the captive nut affects either compression or tension of the rigid member 6 relative to the first and second ends of the body, thereby allowing exquisitely fine adjustment of the instrument and adjustment of the resonant frequency created by the instrument.

In a particularly preferred embodiment, the rigid member 6 is placed under compression and caused to bow in an upward direction to contact the soundboard 4. The distortion of the elongate rigid member and contact with the soundboard can be controlled by introducing a minor deviation from a straight rod ensuring that compression bows the rigid member to bear upon the soundboard. In a particularly preferred embodiment, the rigid member can be adjusted to bear upon the soundboard 4 to vary the degree of pressure applied to the soundboard so as to further improve and control the live frequency generated by the soundboard and subsequent resonant frequency generated by the whole instrument.

The rigid member can be made up of any sufficiently rigid material capable of being placed into compression and/or tension and preferably includes mild steel, timber laminate, polycarbonate, or carbon fibre.

The soundboard 4 of the particularly preferred embodiment is made up of 4 mm laminated marine hoop pine, optionally veneered with decorative veneers and the body may be provided with a back plate of any acoustically neutral material generating either a low or preferably neutral frequency response. In this manner, the frequency response is controlled by the soundboard and operation of the rigid member and is not unnecessarily biased or influenced by the back plate.

Figure 2:
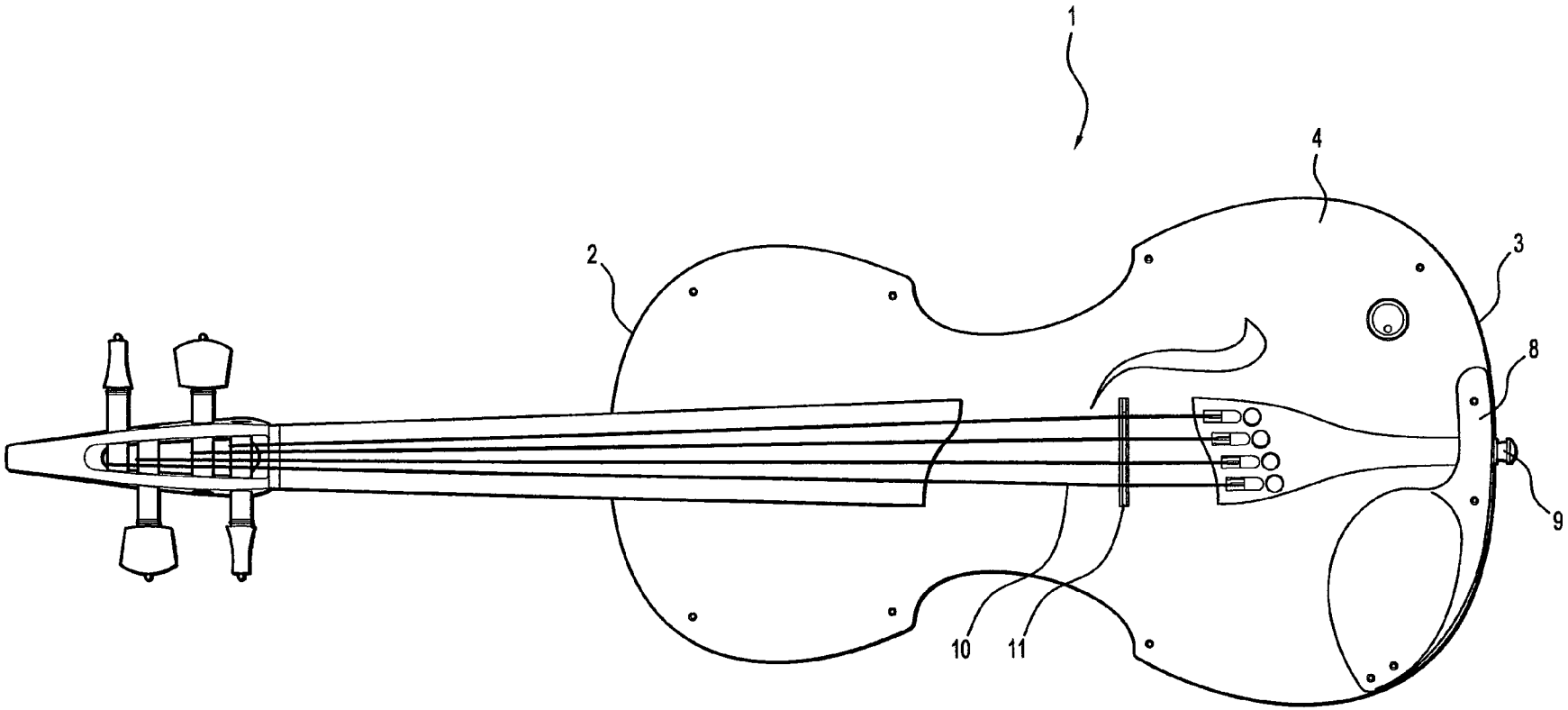
FIG. 2 shows a top plan view.
Figure 3:
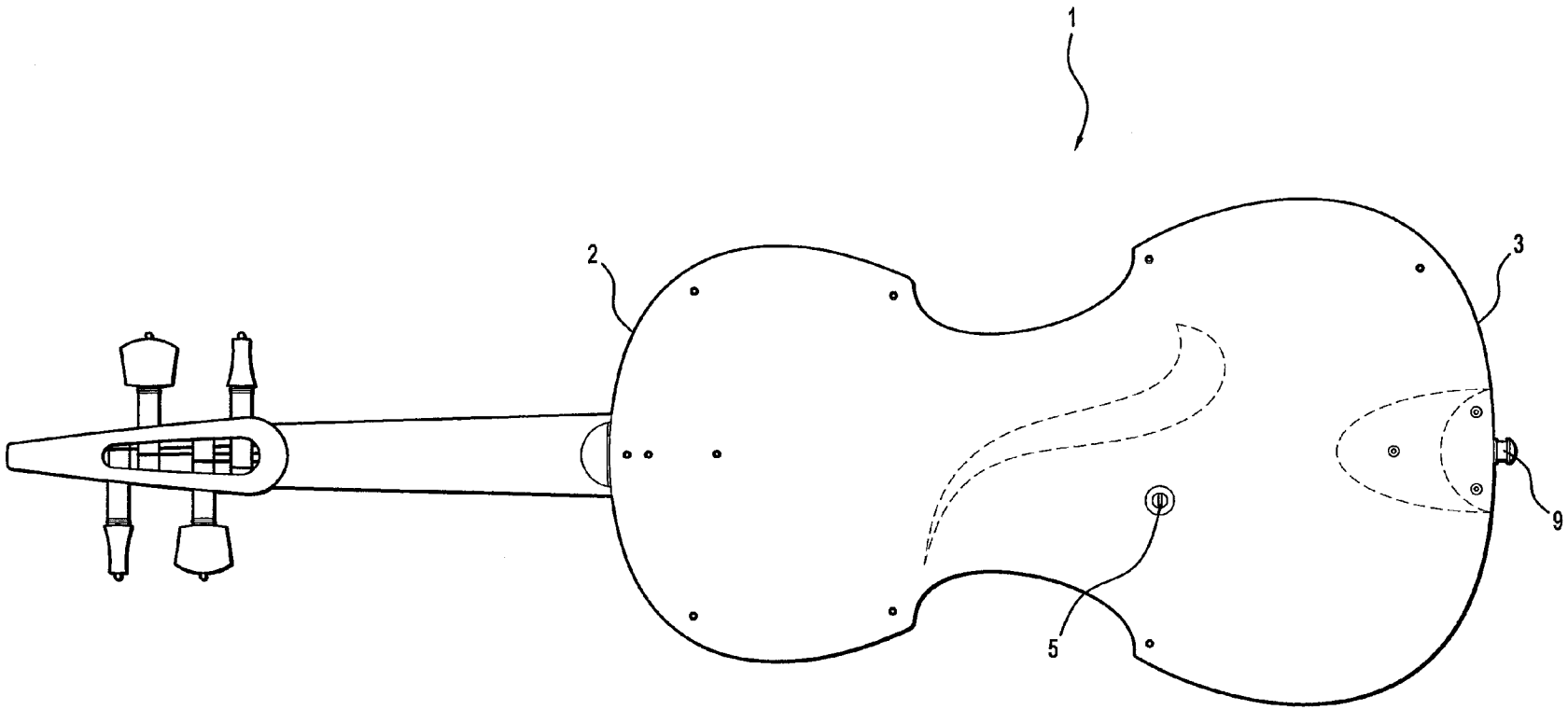
FIG. 3 shows a bottom plan view.

FIGS. 2 and 3 provide top and bottom plan views with the preferred position of the contact microphone 5 clearly given.

It will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

The invention claimed is:

1. An electro-mechanical musical instrument capable of generating a whole or partial instrument resonant frequency, said instrument comprising a body having a first end and a second end, a soundboard positioned between said first and second ends adapted to generate a live frequency response and a contact microphone or sensor adapted to receive said resonant frequency wherein said body includes a rigid member positioned between said first and second ends of said body, said rigid member being adapted to apply tension or compression between said first and second ends of said body and simultaneously contact said soundboard between said first and second body ends such that said application of tension or compression adjusts or modifies said resonant frequency of said instrument.

2. A musical instrument according to claim 1 wherein said rigid member is permanently fixed to said first end and adjustably fitted to said second end to allow ready adjustment to said tension or compression and resultant modification to said resonant frequency.

3. A musical instrument according to claim 1, wherein said rigid member applies compression to said soundboard by drawing said first and second body ends together.

4. A musical instrument according to claim 1, wherein said rigid member is an elongate rod.

5. A musical instrument according to claim 4, wherein said elongate rod is substantially straight with a minor deviation along the longitudinal axis to bias the direction of said distortion so as to effect said contact with the soundboard.

6. A musical instrument according to claim 1, wherein the rigid member is selected from any one of a combination of mild steel, wood laminates, polycarbonate, carbon fibre or other synthetic materials.

7. A musical instrument according to claim 1, wherein said rigid member includes a threaded portion at the second end thereof fitted to the second end of said body by way of a rotatable captive nut to apply said tension or compression as required.

8. A musical instrument according to claim 1, wherein said microphone or sensor is positioned under said soundboard adjacent said rigid member.

9. A musical instrument according to claim 8, wherein said microphone or sensor is positioned adjacent said point of contact between said rigid member and said soundboard.

* * * * *